US006749475B2

(12) United States Patent
Howerton

(10) Patent No.: US 6,749,475 B2
(45) Date of Patent: Jun. 15, 2004

(54) U-SHAPED FLOAT TUBE WITH STABILIZING FRAME

(76) Inventor: Larry Howerton, 2401 W. Main St., Boise, ID (US) 83702

( * ) Notice: Subject to any disclaimer, the term of this patent is extended or adjusted under 35 U.S.C. 154(b) by 0 days.

(21) Appl. No.: 10/268,134

(22) Filed: Oct. 9, 2002

(65) Prior Publication Data

US 2004/0072484 A1 Apr. 15, 2004

(51) Int. Cl.[7] ..... B63C 9/08
(52) U.S. Cl. ..... 441/132; 114/345
(58) Field of Search ..... 441/129, 130, 441/131, 132; 114/345, 351, 353, 354; 472/129

(56) References Cited

U.S. PATENT DOCUMENTS

| | | | | | |
|---|---|---|---|---|---|
| 2,803,839 | A | * | 8/1957 | Mosley | 441/131 |
| 3,117,327 | A | * | 1/1964 | Mathew | 441/132 |
| 3,984,888 | A | * | 10/1976 | DeLano | 441/132 |
| 4,115,888 | A | * | 9/1978 | Sievers | 441/132 |
| 4,662,852 | A | * | 5/1987 | Schneider et al. | 441/132 |
| 4,973,278 | A | | 11/1990 | Williams | 441/131 |
| 5,171,178 | A | * | 12/1992 | Creek et al. | 441/132 |
| 5,217,400 | A | | 6/1993 | Creek et al. | 441/132 |
| 5,290,196 | A | | 3/1994 | Steel | 441/130 |
| 5,360,360 | A | * | 11/1994 | Peterson | 441/130 |
| 5,403,220 | A | * | 4/1995 | Goad, Sr. | 441/130 |
| 5,571,036 | A | | 11/1996 | Hannigan | 441/129 |
| 5,628,658 | A | * | 5/1997 | Clifford | 441/130 |
| 5,692,450 | A | | 12/1997 | Alter et al. | 114/61 |
| 5,878,688 | A | * | 3/1999 | Merrett et al. | 114/354 |
| 6,142,839 | A | * | 11/2000 | Wilcox | 114/345 |
| 6,155,899 | A | | 12/2000 | Boddy | 441/130 |
| 6,168,489 | B1 | | 1/2001 | Huston | 441/130 |
| 6,276,979 | B1 | | 8/2001 | Saltel et al. | 441/132 |
| 6,343,560 | B1 | * | 2/2002 | Myers | 114/354 |
| 6,526,904 | B2 | * | 3/2003 | Liston et al. | 114/345 |

* cited by examiner

*Primary Examiner*—S. Joseph Morano
*Assistant Examiner*—Lars A Olson
(74) *Attorney, Agent, or Firm*—Pedersen & Co., PLLC; Ken J. Pedersen; Barbara S. Pedersen

(57) ABSTRACT

This invention is of a float tube or watercraft comprised of a generally U-shaped inflatable flotation chamber having two generally parallel and laterally disposed leg portions and a rearward portion. The leg portions are preferably formed integrally with the rearward portion. The invention further includes a seating device bridging the two leg portions of the flotation chamber. The invention also has a novel U-shaped stabilizing frame and means for connecting the stabilizing frame to the U-shaped flotation chamber. The U-shaped frame provides support to the opposing legs of the flotation chamber and prevents them from pinching in on the occupant. For additional support, a rigid rod, or tube, extends between the opposing legs of the frame. The means for connecting the stabilizing frame comprises preferably a plurality of channel segments, which are fixedly secured to the leg and rearward portions of the flotation chamber. Alternatively, a continuous channel may be used. In either case, the channel conforms to the U-shape of the flotation chamber and cooperatively and removably receives the U-shaped frame. Typically, the U-shaped stabilizing frame is retained in the channel segments, or continuous channel, generally inside the interior space of U-shaped flotation chamber and substantially in the same plane as the chamber's central axis though alternative placements are possible.

18 Claims, 8 Drawing Sheets

U-SHAPED FLOAT TUBE WITH STABILIZING FRAME

BACKGROUND OF THE INVENTION

1. Field of the Invention

The present invention relates to personal watercraft. More specifically, this invention relates watercraft which incorporate inflatable flotation apparatus.

2. Related Art

There are many personal watercraft designed to accommodate a single individual and to provide suitable buoyancy and transport for that person. The primary application of such devices is to get the "fisherman" to his/her preferred fishing location and to support that person during the fishing activity. Such craft are produced in a large variety of configurations. Many are formed in a closed configuration such as a circle, oval or rectangle. Others have a pair of laterally opposed pontoons interconnected by a seat support structure. And still others have a U-shaped configuration with a supporting seat positioned between the parallel legs of the U. The open end of the U-shaped configuration offers substantial advantages by facilitating the entry of the occupant onto the seat of the device.

Buoyancy for these personal watercraft is provided by both rigid and flexible flotation methods. Rigid devices are often formed from sealed metal or fiberglass structures or water-impermeable, lightweight solids such as certain formulations of closed cell foam and other materials. The non-rigid devices are typically inflatable, formed from flexible and sealable plastic sheeting, woven and impregnated fabrics and rubber. These non-rigid devices are sealed so they may be inflated to produce the desired buoyancy and structural rigidity required to support the occupant and his/her equipment. An inherent disadvantage of an open ended (i.e. U-shaped) flexible flotation device is the tendency of the tube ends to collapse towards each other as the occupant's weight is applied to the seat suspended between the two legs of the device.

The following reviews the prior patent art, pointing out its merits and disadvantages relevant to the improvements provided by the novel features of the present invention.

Williams (U.S. Pat. No. 4,973,278) has invented a "floatable portable seat" for use by sportsman on a body of water. This device comprises an inflatable tube, which is discontinuous at least at one point to provide two terminal ends. In essence, Williams teaches a circular tube with a discontinuity whereby an occupant may "squeeze" between the tube ends to enter the device. After entry, the occupant removably connects the two ends of the circular but discontinuous tube together via cooperating buckles at the ends of the tube. The forward portion of the seat is also removably connected to the tube near the buckled ends. This connection of the tube ends partially reduces their tendency to collapse towards each other after the occupant's weight is applied to the seat. Exit of the occupant from the device can only be accomplished by disconnecting the seat and the tube ends from each other after which the occupant "squeezes" between the disconnected tube ends to exit.

Creek (U.S. Pat. No. 5,217,400 ) discloses a flotation device for sportsman, which includes a U-shaped flotation tube assembly having a pair of opposing parallel legs which are encased by a fabric outer covering. A flexible seating platform is attached to the fabric covering. The seating platform is suspended between the parallel legs of the device. Creek provides a tensioning strap, which spans the outer perimeter of the U-shaped tube assembly and attaches to the ends of the opposing legs. The intent of this strap is to prevent the legs from collapsing inwardly when the occupant's weight is applied to the flexible seat connected between the two legs. This is in fact an inherent problem with all previous U-shaped non-rigid flotation devices.

Hannigan (U.S. Pat. No. 5,570,036) provides a U-shaped "flexible tube floating sling" comprising one or more buoyant flexible foam tubes. A sling is connected within the confines of the U-shape of the foam tubes. Hannigan takes advantage of the inherent collapse of the legs of the U to provide support of a prone or supine occupant. In this application, the occupant's head is placed on or near the closed portion of the U with his/her legs extending towards the open end of the U, the occupant's legs thus being supported by the collapsing tube ends.

Disclosures by Steel (U.S. Pat. No. 5,290,196). Alter et al. (U.S. Pat. No. 5,692,450) and Huston (U.S. Pat. No. 6,168,489), each teach a pair of laterally disposed pontoon floats that are interconnected by a rigid framework that also supports the craft's seat. Thus the occupants of Steel's, Alter's and Huston's devices find it difficult to enter these craft from the water. These approaches also suffer the additional complexity of the rigid and interconnecting framework.

Much like Steel, Alter and Huston, Boddy (U.S. Pat. No. 6,155,899) teaches an inflatable chair consisting of two inflatable floats interconnected by a rigid/semi-rigid seat base, a floor section, an adjustable seat back and a waterproof covering. The rigid/semi-rigid seat base prevents the float ends from collapsing towards each other when the seat is occupied. In use, however, the rigid nature of the seat makes it difficult for a person in the water to enter the device and position himself/herself on the seat.

Saltel et al. (U.S. Pat. No. 6,276,979 ) offer a design similar to that of Hannigan. This disclosure teaches a U-shaped "floating water chair". In this invention, a mesh seat is formed between the legs of the U. The mesh chair seat has a tube sewn into the outer edge following the U-shape of the seat. The tube thus formed is sized to accept common closed cell foam water toys. When the water toy is fully inserted into the sewn tube, buoyancy is provided to the chair. Saltel does not provide means to prevent the tube ends from collapsing towards each other as weight is applied to the seat.

Thus, it is an object of the present invention to provide a means by which the legs of a non-rigid U-shaped flotation device or watercraft may be maintained in parallel relationship with each other at all times. Furthermore, it is a specific object of this invention to provide a device or watercraft which maintains the parallel relationship of the legs when a person is occupying a seat connected between the device's legs. It is yet a further object of this invention to provide a watercraft, which does not restrict or hinder entry of the craft's occupant from the water. It is still a further object of this invention to provide a means for maintaining the parallel relationship of the two legs of a U-shaped water flotation device that is simple, reliable, durable, adjustable and fabricated from common materials.

SUMMARY OF THE INVENTION

The present invention provides a float tube or watercraft comprised of a generally U-shaped inflatable flotation chamber having two nominally parallel and laterally disposed leg portions and a rearward portion connecting the leg portions.

Preferably, the leg portions are formed integrally with the rearward portion. The invented float tube system preferably further includes a seating device connected to and/or bridging the leg portions of the flotation chamber.

The invention also has a novel stabilizing frame and a means for connecting the stabilizing frame to the U-shaped flotation chamber, which improves stability and maneuverability of the float tube system. Preferably, this frame comprises a generally U-shaped structure and an additional support member that extends between its parallel leg portions. This support member eliminates the tendency for the flotation chamber legs to collapse upon each other when weight is applied to the seat.

The means for connecting the stabilizing frame may comprise various fasteners or connectors between the frame and the flotation chamber. Preferably, the means for connecting the frame to the flotation chamber is either a plurality of channel segments (the preferred embodiment) or a continuous channel, which is fixedly secured to the leg and rearward portions of the flotation chamber. The channel segments (or continuous channel) conform to the U-shape of the flotation chamber and cooperatively and removably receive the U-shaped stabilizing frame. Typically, the U-shaped stabilizing frame is situated in the central region, generally parallel to and at or slightly below the mid-plane of the flotation chamber, and preferably nearer the inside surface than the outer surface of the U-shaped flotation chamber. Alternatively, locations higher or lower on the floatation chamber are possible, for example, below the U-shaped flotation chamber.

The stabilizing frame is formed from one or several pieces of lightweight and rigid tubing, for example, stainless steel. A number of alternative assemblies for the frame are possible so long as the pieces may be easily and fixedly joined to one another and secured, as a unit, to the flotation chamber.

The presence of the stabilizing frame provides sufficient structure to the legs of the watercraft to prohibit their collapse when a person's weight is positioned on the craft's seat. This benefit substantially aids the entry of the occupant into the craft and increases his/her comfort while occupying the craft's seat. In addition, with this enhanced stability of the leg portions of the craft, other apparatus may be connected between the stable and parallel legs. Examples include a shelf for placing a tackle box and supplies, other fishing equipment, or a tray providing a beverage holder. Another advantageous feature of this invention is that the U-shaped frame may be easily removed to allow folding or rolling of the flotation chamber for simplified transport and storage.

These and many other features and attendant advantages of the invention will become apparent as the invention becomes better understood by reference to the following detailed descriptions and accompanying drawings.

BRIEF DESCRIPTION OF THE DRAWINGS

FIG. 6A illustrates a two-piece frame with a threaded connection on one side of the frame. FIG. 6B illustrates a three-piece frame with two threaded connections. FIG. 6C illustrates a two-piece frame with a friction connection generally in the middle of the frame's arc.

DESCRIPTION OF THE PREFERRED EMBODIMENTS

Figure 1:
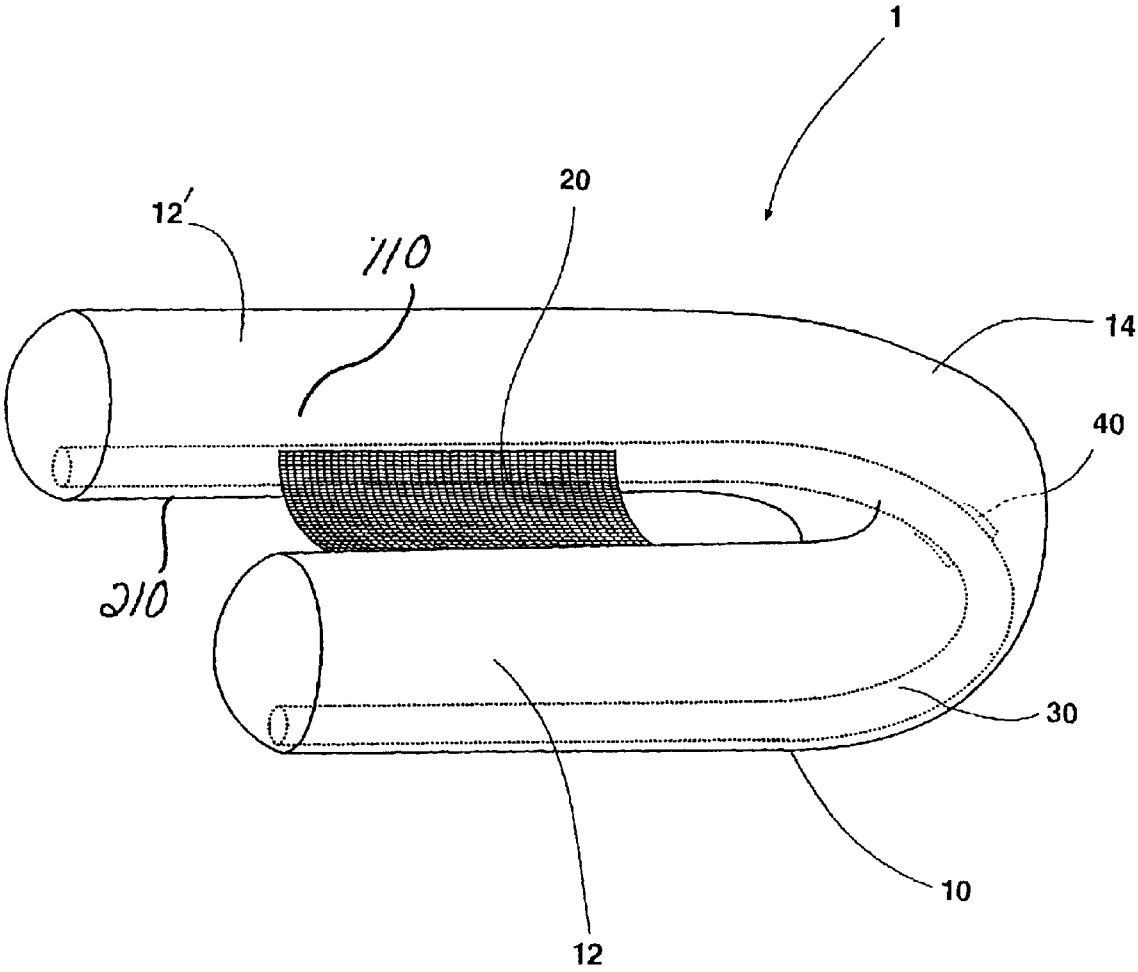
FIG. 1 is a top, right perspective view of an embodiment of the invented float tube with U-shaped stabilizing frame, in which an embodiment of the frame system is shown generally underneath the flotation chamber.

FIG. 1 depicts the invented float tube 1. Fisherman, hunters, sportsmen and the like will typically use this flotation device. This invention is generally comprised of a U-shaped inflatable flotation chamber 10 having two generally parallel and laterally disposed leg portions 12 and 12' and a rearward portion 14. The leg portions are preferably formed integrally with the rearward portion. Preferably, a flexible seating device 20 is connected to and bridges the leg portions 12 and 12' of the flotation chamber 10 though a rigid, or other seating device may be possible. FIG. 1 also shows in phantom an embodiment of the frame feature of this invention, the U-shaped stabilizing frame 30 and means 40 for connecting the frame to the flotation chamber 10. The latter important features are better visualized in FIG. 2.

Figure 2:
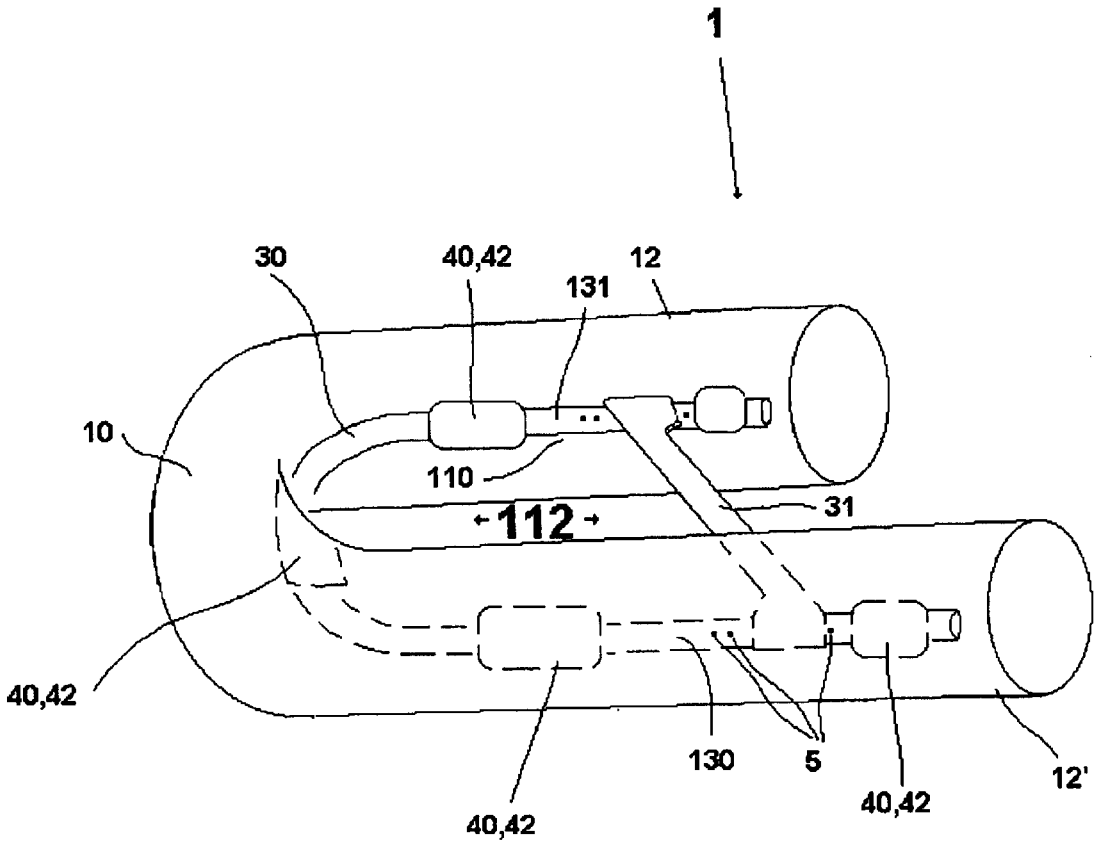
FIG. 2 is a top, left perspective view of an especially preferred embodiment of the invented float tube showing the U-shaped frame generally centrally located in the space between the legs of the flotation chamber and retained in channel segments.
Figure 7:
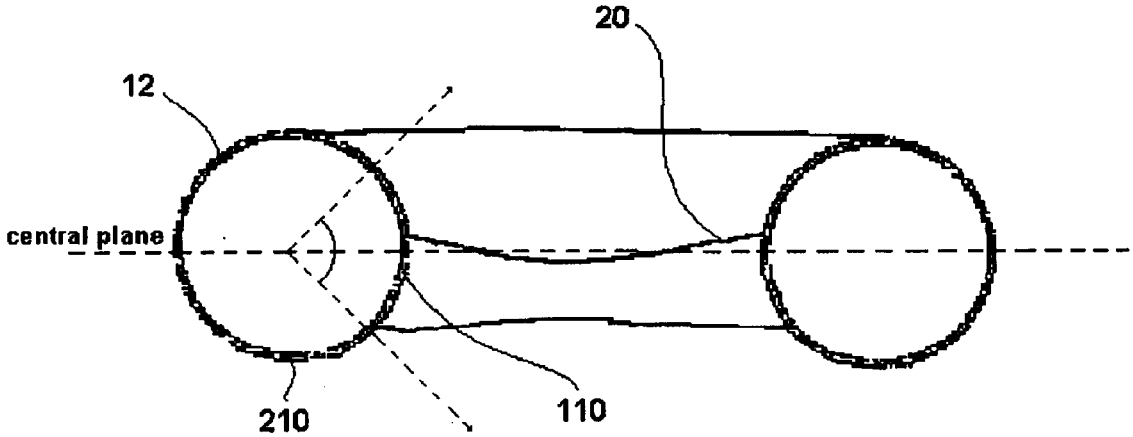
FIG. 7 shows the preferred region for attaching the U-shaped stabilizing frame to the floatation chamber relative to the central plane of the chamber.

FIG. 2 shows the preferred embodiment of the invention wherein the means 40 for connecting the U-shaped stabilizing frame to the flotation chamber comprises a plurality of channel segments 42 fixedly secured to leg portions 12 and 12' and rearward portion 14 of the flotation chamber. In FIG. 2, the preferred frame is located generally at or within a short distance of the central plane passing through the flotation chamber. Preferably, the frame is attached to the flotation chamber at locations on the central plane, or within about 45 degrees above or below this plane, as shown in FIG. 7. More preferably, the frame is located at or below the central plane in the preferred region. When the frame is attached at or near the central plane, it may be said to be connected to the inside region 110 of the flotation chamber. When the frame is attached lower on the flotation chamber, it may be said to be attached at or near the bottom region 210 of the flotation chamber.

Figure 3:
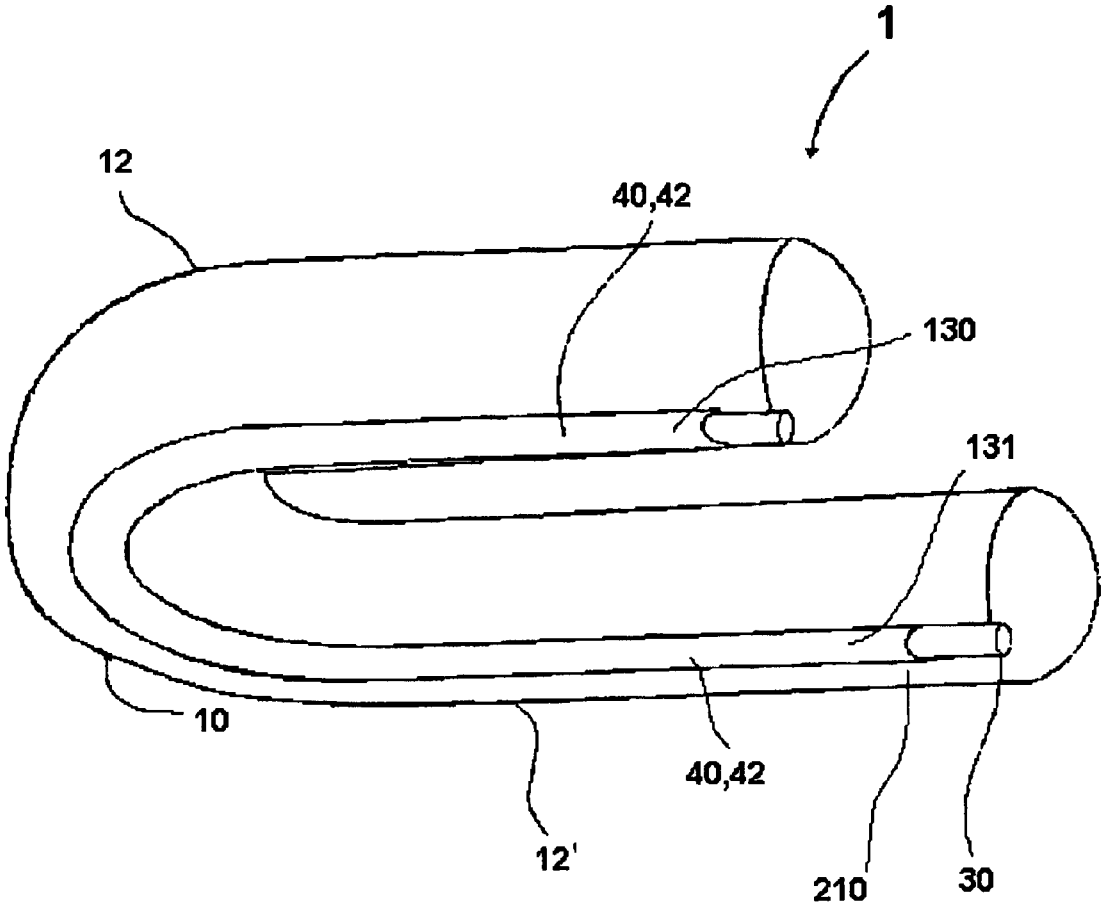
FIG. 3 is a perspective view from the bottom of the invented float tube showing an alternative means of securing the stabilizing frame, and wherein the stabilizing frame is generally underneath the flotation chamber.
Figure 4:
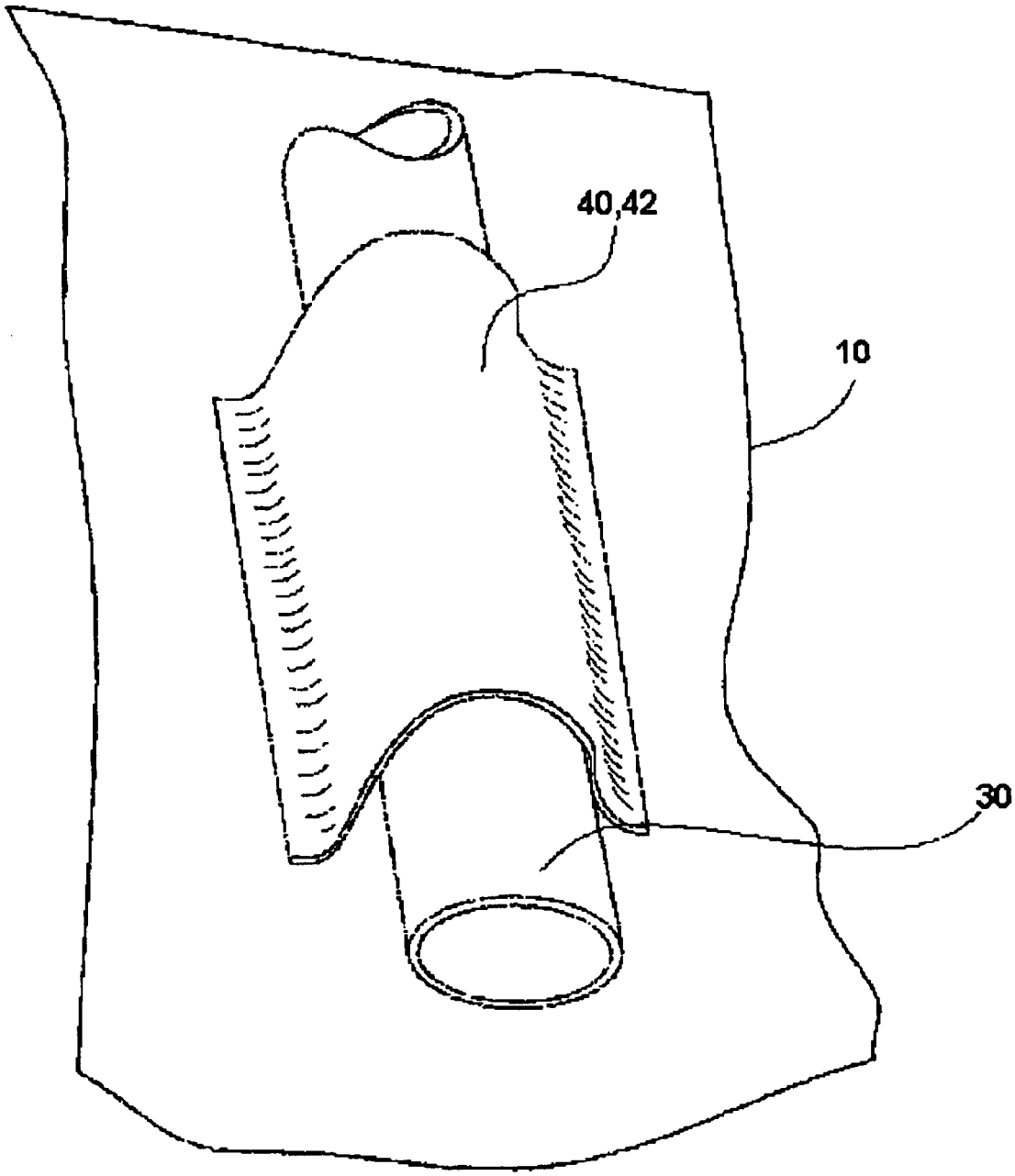
FIG. 4 is an expanded view of a channel segment such as may be used to secure the stabilizing frame to the flotation chamber.

FIG. 3 presents an alternative means 40 for connecting the flotation chamber and frame. In this embodiment, the connecting means is comprised of a single, continuous channel 42'. It is important to note, as shown in FIGS. 2 and 3, that both embodiments, i.e. channel segments 42 and continuous channel 42', conform to the U-shape configuration of the flotation chamber and that they both cooperatively and detachably receive the U-shaped stabilizing frame. FIG. 4 is an enlarged view of showing the details of channel segments 42.

Figure 5A:
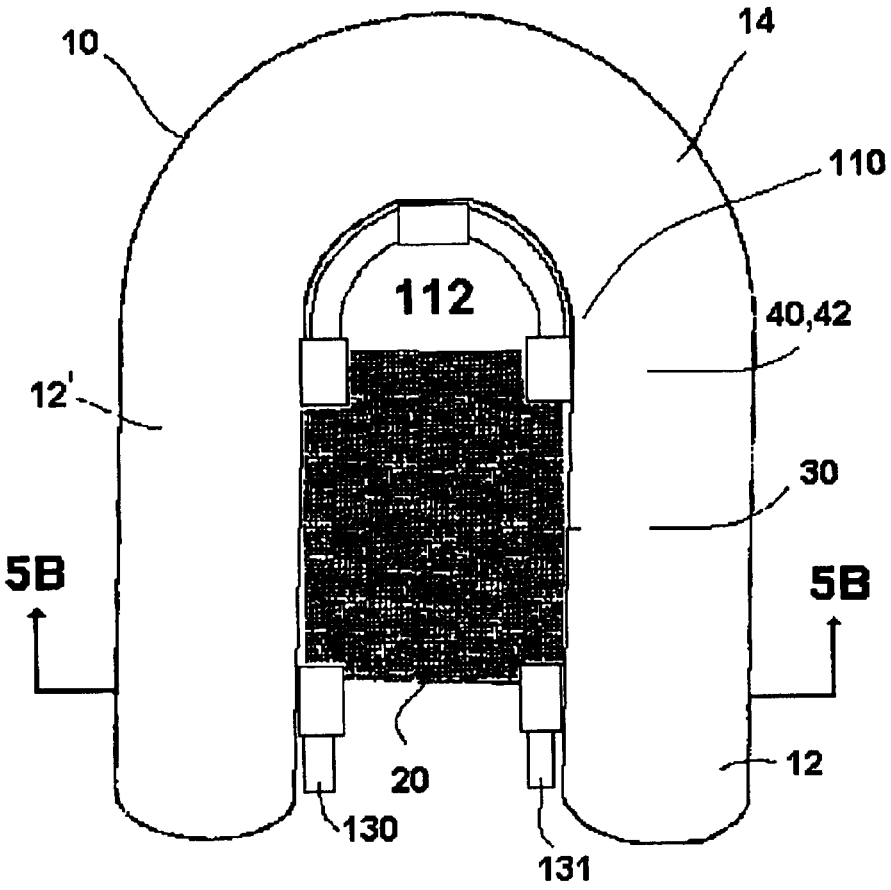
FIG. 5A shows the preferred positioning of the stabilizing frame on the flotation chamber, wherein the stabilizing frame is generally parallel to, and at or slightly below, the central plane of the flotation chamber and generally inside the inner space created by the curvature of the flotation chamber.

The frame 30 may be mounted to the flotation chamber 10 in a number of different positions. Preferably, the frame 30 is surrounded by the flotation chamber 10 and is mounted in the same plane or about the same plane as the chamber's central axis, as shown in FIG. 5A. This way, the frame is preferably generally inside the interior space 112 and parallel to the U-shape flotation chamber. This way also, the frame 30 is at a good level to receive and hold the flexible seating device 20 as it is "slung" across the interior space 112 and connected to the flotation chamber by means of the frame.

Figure 5B:
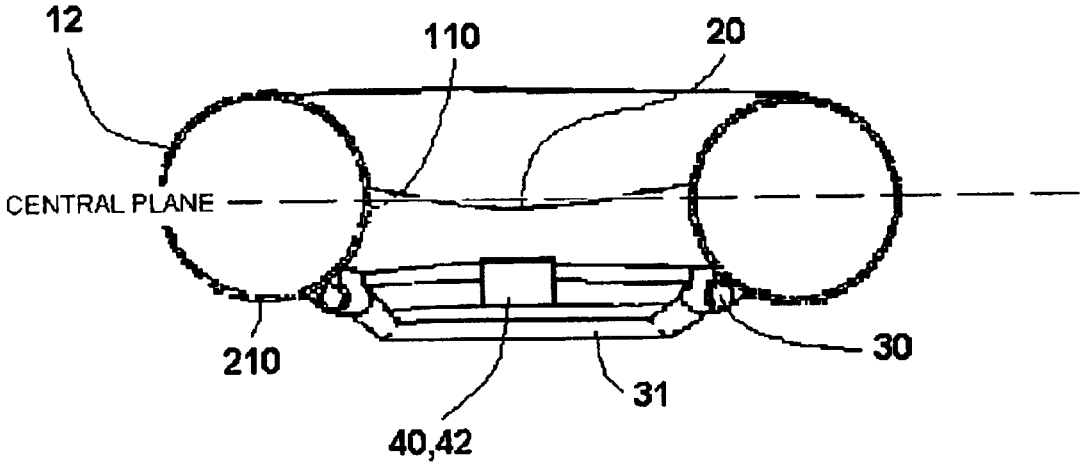
FIG. 5B show a possible alternative for positioning the stabilizing frame on the flotation chamber, wherein the stabilizing frame is lower on the flotation chamber, and wherein a cross-member support rod is included.

Other alternatives are possible so long as the frame is still able to provide sufficient support to the laterally disposed legs 12 and 12'. For example, FIG. 5B shows the frame mounted lower on the flotation chamber. FIG. 5B also shows the preferred placement of a support rod 31 between the opposing legs of the frame 30. The support rod 31 preferably extends between the two "legs" of the frame 130 and 131 and provides additional support to the frame and helps prevent the legs 12 and 12' of the flotation chamber 10 from pinching in upon the occupant. This supporting element may be modified to accommodate mounting the frame in various positions without compromising the functionality of the apparatus.

The seating apparatus 20 may be suspended between the laterally disposed legs 12 and 12' using a variety of techniques. For example, when the frame is mounted to the mid-section of the flotation chamber 10 (i.e. when the frame is at or near the central plane of the flotation chamber), the seat may be attached to the frame. This may be accomplished, for example, by sliding mesh loops situated on either side of the seating device onto the frame or by buckling the opposing ends of the seating device to the frame legs 130 and 131. The seating device may also be directly attached to the laterally disposed legs 12 and 12' of the flotation chamber 10 (as suggested by FIG. 1), for example, when the stabilizing frame is beneath the flotation chamber or otherwise low enough on the flotation chamber that it is difficult or uncomfortable for the seating apparatus 20 to be slung between the legs of the frame. For example, the seat ends may be sewn onto a fabric shell, which surrounds the flotation chamber. Also, the seating arrangement may include additional features such as a backrest that are fixedly attached to the flotation chamber.

Figure 6A:
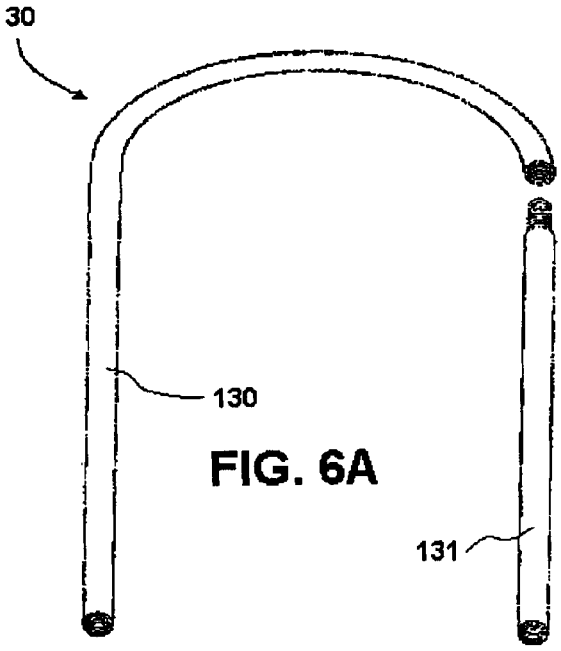
FIG. 6A–C present several of many embodiments of the U-shaped stabilizing frame comprising multiple sections.
Figure 6B:
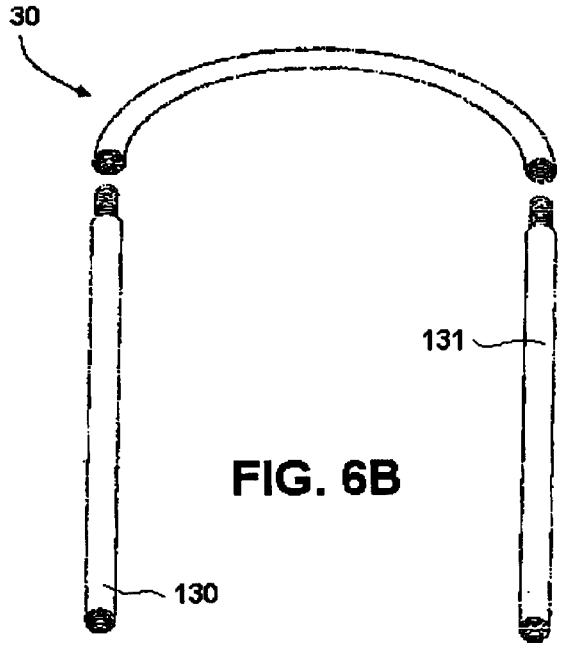
Figure 6C:
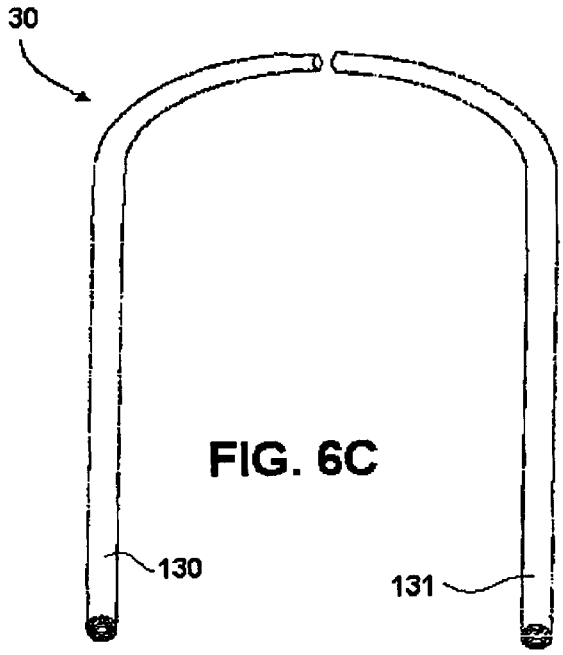
Figure 6D:
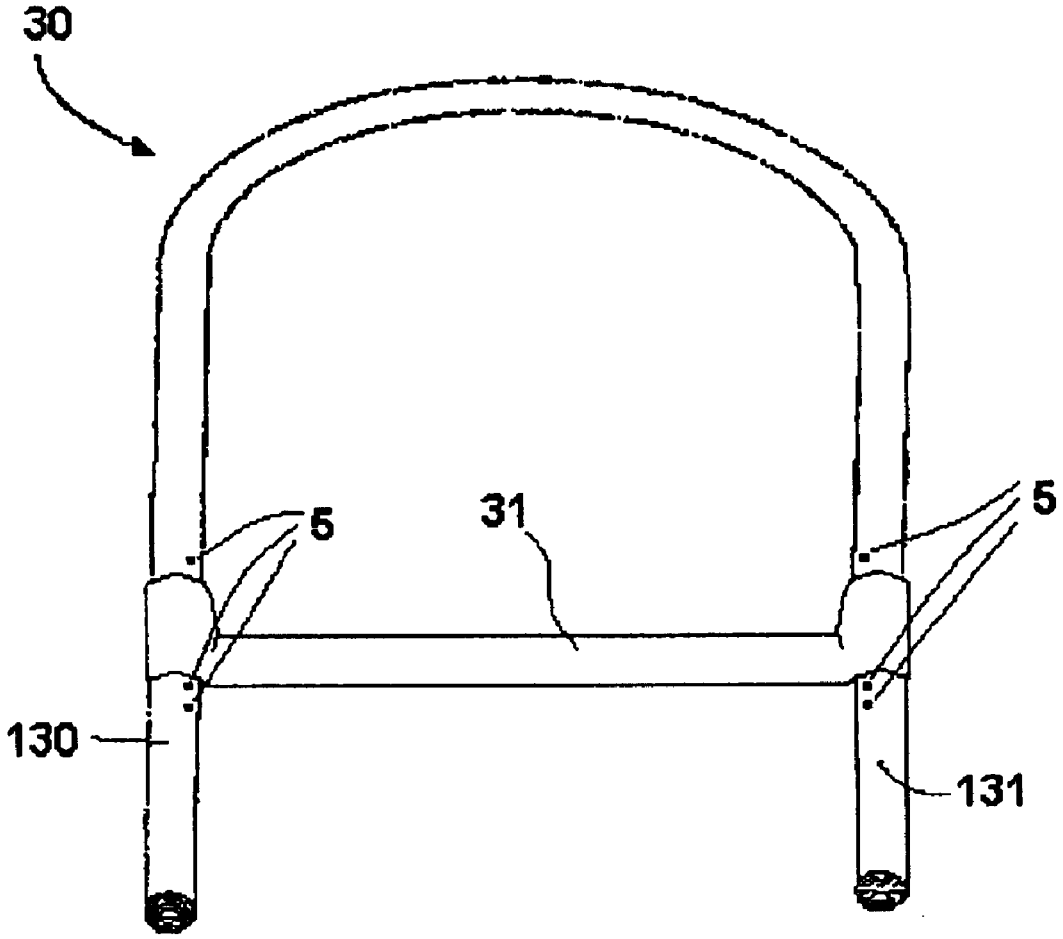
FIG. 6D illustrates an embodiment of the stabilizing frame with the support rod adjustably attached to both legs of the frame.

In the preferred embodiment, U-shaped stabilizing frame 30 is formed in one continuous and unbroken piece as shown in FIG. 2. However, an acceptable and highly effective alternative embodiment includes a plurality of rod sections, each rod section being removably but securely connected to another rod section. As shown in FIGS. 6A–C, these rod sections may be threaded or otherwise joined together. Alternative methods of interconnecting the rod segments include friction fit, with or without interior elastic cords, as with bent poles. Any other alternative, however, must provide a sturdy connection between the segments and be sufficiently smooth so that the assembled rod may be easily inserted into and removed from segmented channel 42 or continuous channel 42'. For example a releasable pin arrangement such as used to alter the length of canes, crutches and the like may be used. Such an assembly may also permit adjustments to the length of the legs, as shown in FIG. 6D. Also, such an assembly, or other means of adjustment, may be provided to facilitate repositioning of the support rod 31. For example, a releasable pin assembly such as is shown in FIGS. 2 and 6D, facilitates movement of the support rod slightly forward or backward. Pinholes 5 in FIGS. 2 and 6D show several possible positions, though other locations for the support rod are foreseeable. Two-section alternatives for the stabilizing frame 30 are shown in FIGS. 6A and 6C, and a three-section alternative is shown in FIG. 6B. However, more, or fewer, segments may be acceptable.

The materials used in the fabrication of this invention are not critical in so far as they meet the demands for durability required by the relatively rugged application environment encountered in the outdoors. Any of a large variety of known materials commonly used in flotation devices is acceptable. Examples include impregnated fabrics, polyurethane, vinyl, rubber and the like.

Channels 42, 42' are preferably formed from the same material as the flotation chamber. These channels are fixedly secured to the flotation chamber via any of several known methods, which are compatible with the material from which the flotation chamber is fabricated. Depending on the flotation material, such methods include adhesives, thermal bonding, molding, and sealed stitching. The use of Velcro™ type fasteners is also acceptable.

U-shaped stabilizing frame 30 is formed preferably from lightweight, rigid tubing that provides both strength and corrosion resistance. For example, certain lightweight steel alloys and aluminum are acceptable. Alternatively the frame may be fabricated from reinforced fiberglass or laminated wood.

Although this invention has been described above with reference to particular means, materials and embodiments, it is to be understood that the invention is not limited to these disclosed particulars, but extends instead to all equivalents within the scope of the following claims.

I claim:

1. A float tube for use by fisherman, hunters, sportsmen and the like which comprises:

a generally U-shaped, inflatable flotation chamber having two generally parallel and laterally disposed leg portions and a rearward portion;

a seating device connected to and bridging the leg portions of said U-shaped flotation chamber;

a U-shaped stabilizing frame; and a system for connecting said stabilizing frame to said two leg portions of said U-shaped flotation chamber; wherein said system for connecting said stabilizing frame comprises a continuous channel fixedly secured to the leg and rearward portions of said flotation chamber, said channel further cooperatively and removably receiving said U-shaped stabilizing frame.

2. A float tube according to claim 1, wherein the continuous channel is fixedly secured to said flotation chamber by a method selected from the group consisting of adhesives, thermal bonding, molding, and sealed stitching.

3. A float tube according to claim 1, wherein the U-shaped stabilizing frame is rigid.

4. A float tube according to claim 1, wherein said U-shaped stabilizing frame is formed in one continuous and unbroken piece.

5. A float tube according to claim 1, wherein said U-shaped stabilizing frame is formed from a plurality of rod sections, each rod section being removably and adjustably connected to another rod section.

6. A U-shaped stabilizing frame according to claim 5, wherein said frame includes a support member, which extends between the opposed legs of said frame.

7. A float tube according to claim 1, wherein said U-shaped stabilizing frame is formed from a material selected from the group consisting of metals, reinforced fiberglass and laminate wood.

8. A float tube according to claim 1, wherein said flotation chamber has a central plane and wherein said stabilizing frame is located on the flotation chamber within about 45 degrees of said central plane.

9. A float tube for use by fisherman, hunters, sportsmen and the like which comprises:

a generally U-shaped, inflatable flotation chamber having two generally parallel and laterally disposed leg portions and a rearward portion;

a seating device connected to and bridging the leg portions of said U-shaped flotation chamber;

a U-shaped stabilizing frame; and a system for connecting said stabilizing frame to said two leg portions of said U-shaped flotation chamber, wherein said system for connecting said stabilizing frame comprises a plurality of channel segments fixedly secured to the leg and rearward portions of said flotation chamber, said channel segments further cooperatively and removable receiving said U-shaped stabilizing frame wherein the channel segments are fixedly secured to said flotation chamber by a method selected from the group consisting of adhesives, thermal bonding, molding, and sealed stitching.

10. A float tube according to claim 9, wherein the U-shaped stabilizing frame is rigid.

11. A float tube according to claim 9, wherein said U-shaped stabilizing frame is formed in one continuous and unbroken piece.

12. A float tube according to claim 9, wherein said U-shaped stabilizing frame is formed from a plurality of rod sections, each rod section being removably and adjustably connected to another rod section.

13. A U-shaped stabilizing frame according to claim 12, wherein said frame includes a support member, which extends between the opposed legs of said frame.

14. A float tube according to claim 9, wherein said U-shaped stabilizing frame is formed from a material selected from the group consisting of metals, reinforced fiberglass and laminate wood.

15. A float tube according to claim 9, wherein said flotation chamber has a central plane and wherein said stabilizing frame is located on the flotation chamber within about 45 degrees of said central plane.

16. A float tube for use by fisherman, hunters, sportsmen and the like which comprises:

a generally U-shaped, inflatable flotation chamber having two generally parallel and laterally disposed leg portions and a rearward portion;

a seating device connected to and bridging the leg portions of said U-shaped flotation chamber;

a U-shaped stabilizing frame; and a system for connecting said stabilizing frame to said two leg portions of said U-shaped flotation chamber:

wherein said U-shaped stabilizing frame is formed from a plurality of rod sections, each rod section being removably and adjustably connected to another rod section, wherein said frame includes a support member that extends between the opposed legs of said frame wherein the position of said support member is adjustable.

17. A float tube for use by fisherman, hunters, sportsmen and the like which comprises:

a generally U-shaped, inflatable flotation chamber having two generally parallel and laterally disposed leg portions and a rearward portion;

a seating device connected to and bridging the leg portions of said U-shaped flotation chamber;

a U-shaped stabilizing frame; and a system for connecting said stabilizing frame to said two leg portions of said U-shaped flotation chamber wherein, said U-shaped flotation chamber has a bottom region to which said system for connecting said stabilizing frame is fixedly secured.

18. A float tube for use by fisherman, hunters, sportsmen and the like which comprises:

a generally U-shaped, inflatable flotation chamber having two generally parallel and laterally disposed leg portions and a rearward portion;

a seating device connected to and bridging the leg portions of said U-shaped flotation chamber;

a U-shaped stabilizing frame, and a system for connecting said stabilizing frame to said two leg portions of said U-shaped flotation chamber wherein, said U-shaped flotation chamber has an inside region to which said system for connecting said stabilizing frame is fixedly secured.

* * * * *